US006405916B1

(12) United States Patent
Olden

(10) Patent No.: US 6,405,916 B1
(45) Date of Patent: Jun. 18, 2002

(54) APPARATUS FOR CONNECTING WOODEN COMPONENTS

(75) Inventor: Marc Olden, Pacific, MO (US)

(73) Assignee: Columbia Insurance Company, Omaha, NE (US)

( * ) Notice: Subject to any disclaimer, the term of this patent is extended or adjusted under 35 U.S.C. 154(b) by 111 days.

(21) Appl. No.: 09/612,813

(22) Filed: Jul. 10, 2000

Related U.S. Application Data

(63) Continuation-in-part of application No. 09/419,582, filed on Oct. 18, 1999, now Pat. No. 6,330,963.

(51) Int. Cl.[7] ..... B27F 7/02

(52) U.S. Cl. ..... 227/4; 227/99; 227/152; 227/154

(58) Field of Search ..... 227/99, 100, 4, 227/152, 154, 151, 136; 100/913, 918, 229 R

(56) References Cited

U.S. PATENT DOCUMENTS

| | | | | | |
|---|---|---|---|---|---|
| 3,100,301 | A | | 8/1963 | Black | 1/60 |
| 3,591,067 | A | | 7/1971 | Vital | 227/4 |
| 3,713,381 | A | * | 1/1973 | Mort et al. | 227/152 |
| 3,848,495 | A | | 11/1974 | Youra | 83/128 |
| 3,895,708 | A | | 7/1975 | Jureit et al. | 206/53 |
| 3,913,816 | A | | 10/1975 | Jureit et al. | |
| 3,939,542 | A | | 2/1976 | Reggi | 29/203 |
| 3,939,548 | A | | 2/1976 | Jureit et al. | 29/432 |
| 3,964,663 | A | | 6/1976 | Jureit et al. | 227/95 |
| 4,081,893 | A | | 4/1978 | Jureit et al. | |
| 4,275,854 | A | | 6/1981 | Jureit et al. | |
| 4,426,059 | A | * | 1/1984 | Mort | 227/152 |
| 4,429,629 | A | * | 2/1984 | Leonard | 100/913 |
| 4,567,821 | A | * | 2/1986 | McDonald | 227/152 |
| 4,627,564 | A | * | 12/1986 | Bowser | 227/154 |
| 4,650,104 | A | * | 3/1987 | Seki | 227/154 |
| 4,691,554 | A | * | 9/1987 | Murphy | 100/224 |
| 5,085,414 | A | | 2/1992 | Weaver | |
| 5,092,028 | A | | 3/1992 | Harnden | |
| 5,873,567 | A | | 2/1999 | Williams | |

OTHER PUBLICATIONS

U.K. Search Report Under Section 17, Application No. GB 0025567.9, Apr. 24, 2001.

* cited by examiner

*Primary Examiner*—Scott A. Smith
(74) *Attorney, Agent, or Firm*—Senniger, Powers, Leavitt & Roedel

(57) ABSTRACT

Apparatus for connecting wood members with a connector plate segmented from a continuous strip of connector plates. The connector plates have integral nails extending from one face of the plate. The apparatus includes a feeder for feeding the strip forward to a position where the connector plate is segmented from the strip. A driver drives the segmented plate into the wood members. The apparatus is characterized by a table for the emplacement of the wood members in a pattern for being fastened together. The table is mounted for movement between a position out from under the driver for emplacement of the wood members and a position under the driver for the driving of a segmented connected plate down for penetration of its nails into the wood members. The table has an upwardly facing surface with indicia thereon indicative of the locations of edges of the connector plate. The table also has slots and locating stops to facilitate holding the wood member in the pre-selected pattern on the table.

19 Claims, 8 Drawing Sheets

APPARATUS FOR CONNECTING WOODEN COMPONENTS

This application is a Continuation-in-Part of U.S. patent application Ser. No. 09/419,582, filed Oct. 18, 1999 now U.S. Pat. No. 6,330,963.

This invention relates to apparatus for connecting wooden components and the like, and more particularly to apparatus for emplacement of wooden components in position for being joined together (jigging said members) and having means for fastening said members together by driving connector plates (nailing plates) thereunto.

BACKGROUND OF THE INVENTION

The invention is in the field of automated wooden component connection apparatus of the type in which components are placed in position on a table (jigged) in the position in which they are to be fastened together, and connector plates (nailing plates) segmented from continuous connector plate strip are driven into said components, one from above, one from below through an opening in the table, for the fastening together of said components. This type of apparatus is well known in the art; reference may be made to the copending coassigned Ser. No. 09/347,326, filed Jul. 2, 1999, entitled Coil Advance Drive for an Apparatus for Applying Links of Connector Plate Coils to Wooden Frames, showing such apparatus, said application being incorporated herein by reference. An example of such a machine is Model No. 35500 Coilfed Machine available from MiTek Industries, Inc. of St. Louis, Missouri. Another example of such a machine is shown in U.S. Pat. No. 3,913,816. These machines are characterized by their use of a coil of connector plate material, such as shown in U.S. Pat. No. 3,895,708, rather than preformed individual plates. Said prior apparatus is used, for example, to make hip roof trusses or wood crates, for manufacturing wooden frames for furniture or box springs, and to make other wood assemblies. The prior apparatus has been generally satisfactory but, at times, some difficulty has been encountered in the emplacement of the wood members in jigged position on the table due to the obstruction of the table by connector plate segmenting and driving instrumentalities overhanging the table.

In the operation of such machines, the initial setup of the jigging members to properly position the wooden members has been difficult because of the different types and sizes of wooden members used, the variety of angles that they are positioned relative to one another and because of the variety of sizes of nailing plates used to join the wooden members together. Further, setting the jigging members sometimes requires work in the plate pressing area which raises issues of personnel safety.

BRIEF SUMMARY OF THE INVENTION

Among the several objects of this invention may be noted the provision of apparatus of the type described above improved to the extent of facilitating the manual emplacement (jigging) of the wooden members to be fastened together by the connector plates; the provision of such apparatus wherein the emplacement may be carried out without obstruction from the connector plate segmenting and driving instrumentalities; the provision of such apparatus enabling set-up of various jigging patterns for the wooden members; the provision of such apparatus that is easy and efficient to set up any desired jigging pattern; the provision of such apparatus that improves personnel safety; and the provision of such apparatus which is of relatively simple and economical construction and relatively simple and convenient to use.

In general, apparatus of this invention is for connection of wooden components or the like in which wood members are fastened together by a connector plate segmented from a continuous strip of connector plates, said plates having integral nails extending from one face thereof and connected end-to-end lengthwise of the strip. It comprises a feeder operable to feed the strip forward with its nails extending down to bring the leading plate of the strip to a position for being segmented from the strip and driven downward, and a driver for driving the segmented strip down. It is characterized in having a table for the emplacement thereon of wood members in a pattern for being fastened together, said table being mounted for movement between a position out from under said driver for emplacement of said members and a position under said driver for the driving of a segmented connector plate down for penetration of its nails into said members.

Other objects and features will be in part apparent and in part pointed out hereinafter.

BRIEF DESCRIPTION OF THE DRAWINGS

Corresponding reference characters indicate corresponding parts throughout several views of the drawings.

DESCRIPTION OF THE PREFERRED EMBODIMENT

Figure 1:
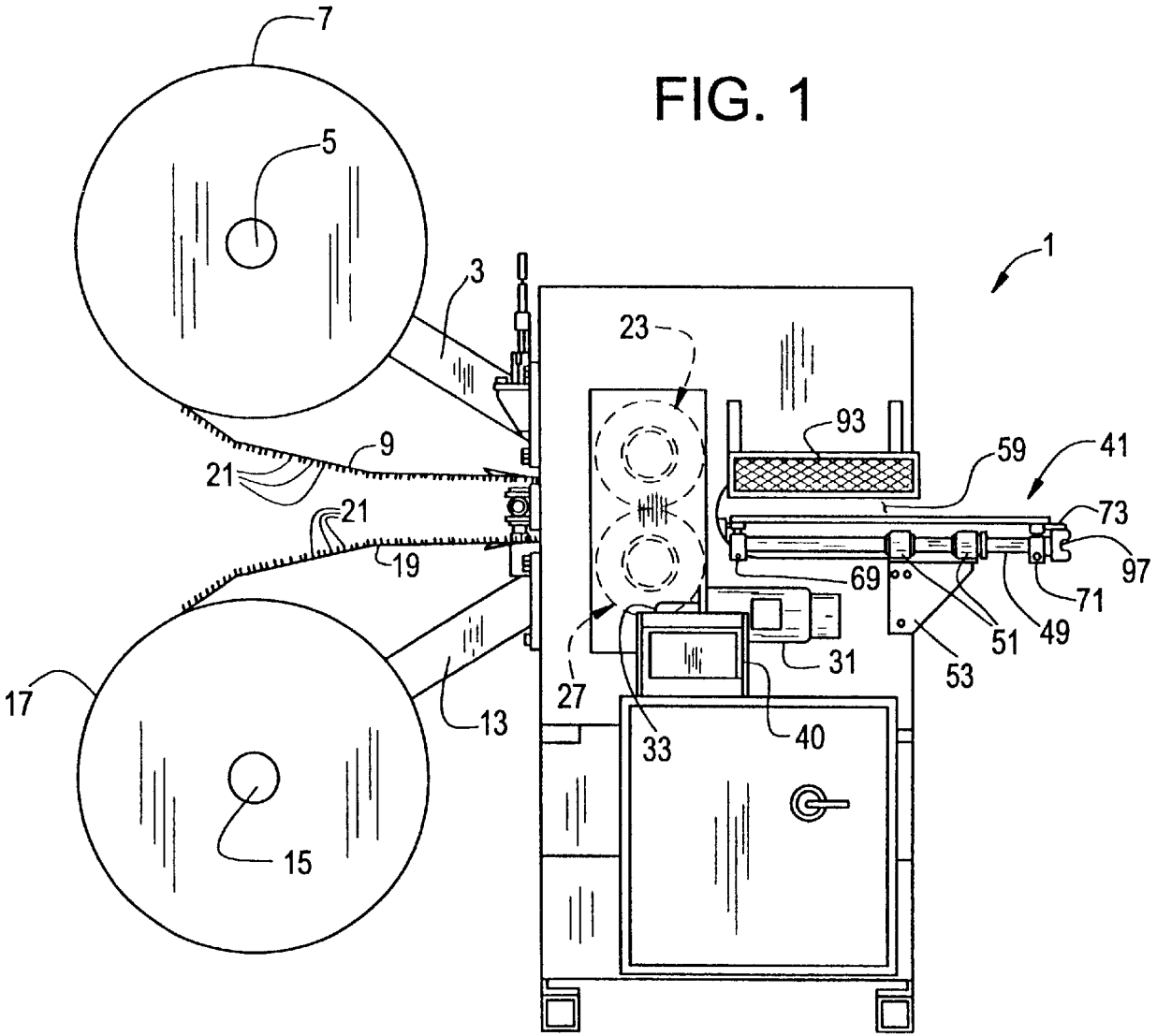
FIG. 1 is a view in elevation of one side of apparatus embodying the invention.
Figure 2:
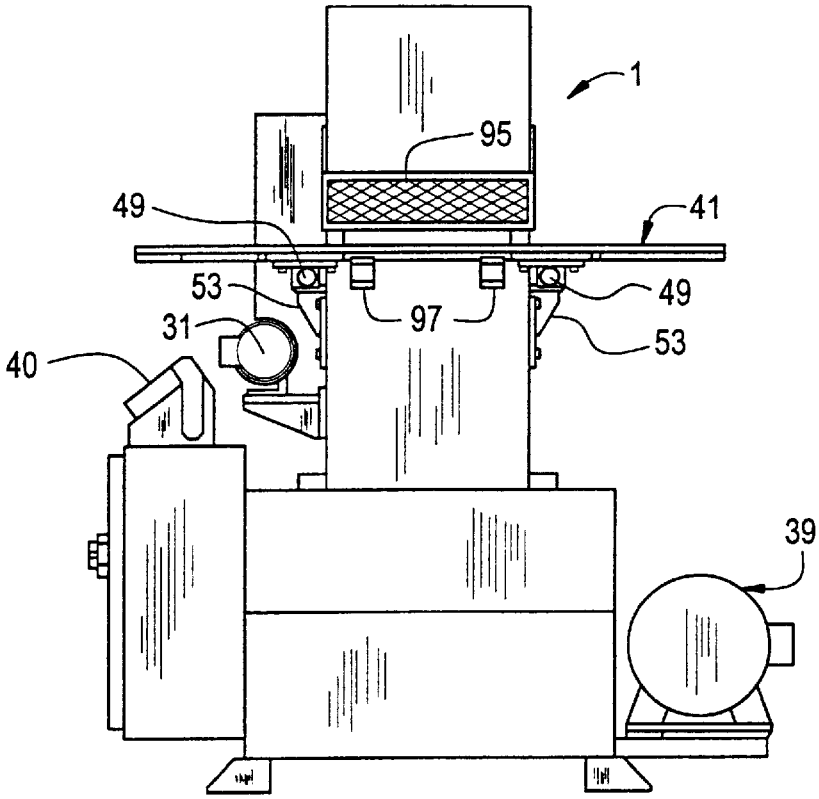
FIG. 2 is a view in front elevation of the apparatus.
Figure 3:
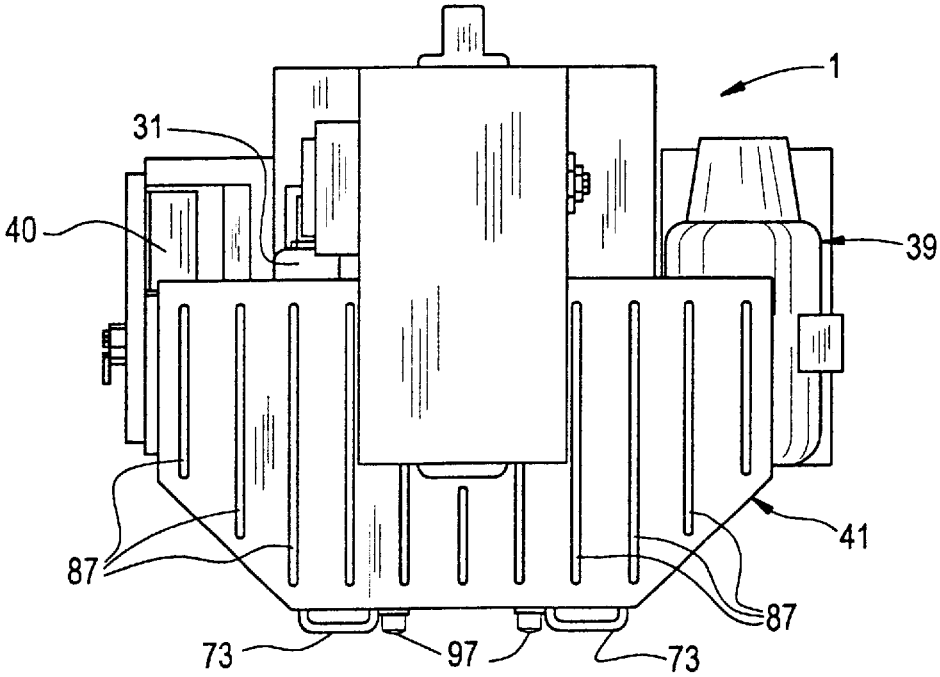
FIG. 3 is a plan of FIG. 2.

Referring to the drawings, first more particularly to FIGS. 1–3, apparatus of this invention is shown to comprise a frame indicated in its entirety by the reference numeral 1 having an upper arm 3 extending outwardly therefrom in what amounts to rearward direction having a spindle 5 at its outer end carrying a supply in the form of a coil 7 of a strip 9 of connector plates (which may also be referred to as nailing plates) and a lower arm 13 extending outwardly therefrom below the upper arm having a spindle 15 at its outer end carrying another supply in the form of a coil 17 of a strip 19 of connector plates (which may be the same as strip 9). Such connector plates and strips thereof are well known in the art and it will be readily understood by those conversant with the art that each connector plate is a metal (usually steel) plate having nails 21 integrally formed therefrom extending from one face thereof, strips of said plates comprising a multiplicity of the plates integrally connected end-to-end lengthwise of the strip, the leading plate of the strip being adapted to be segmented from the strip and driven into pieces of wood for fastening them together.

Figure 5:
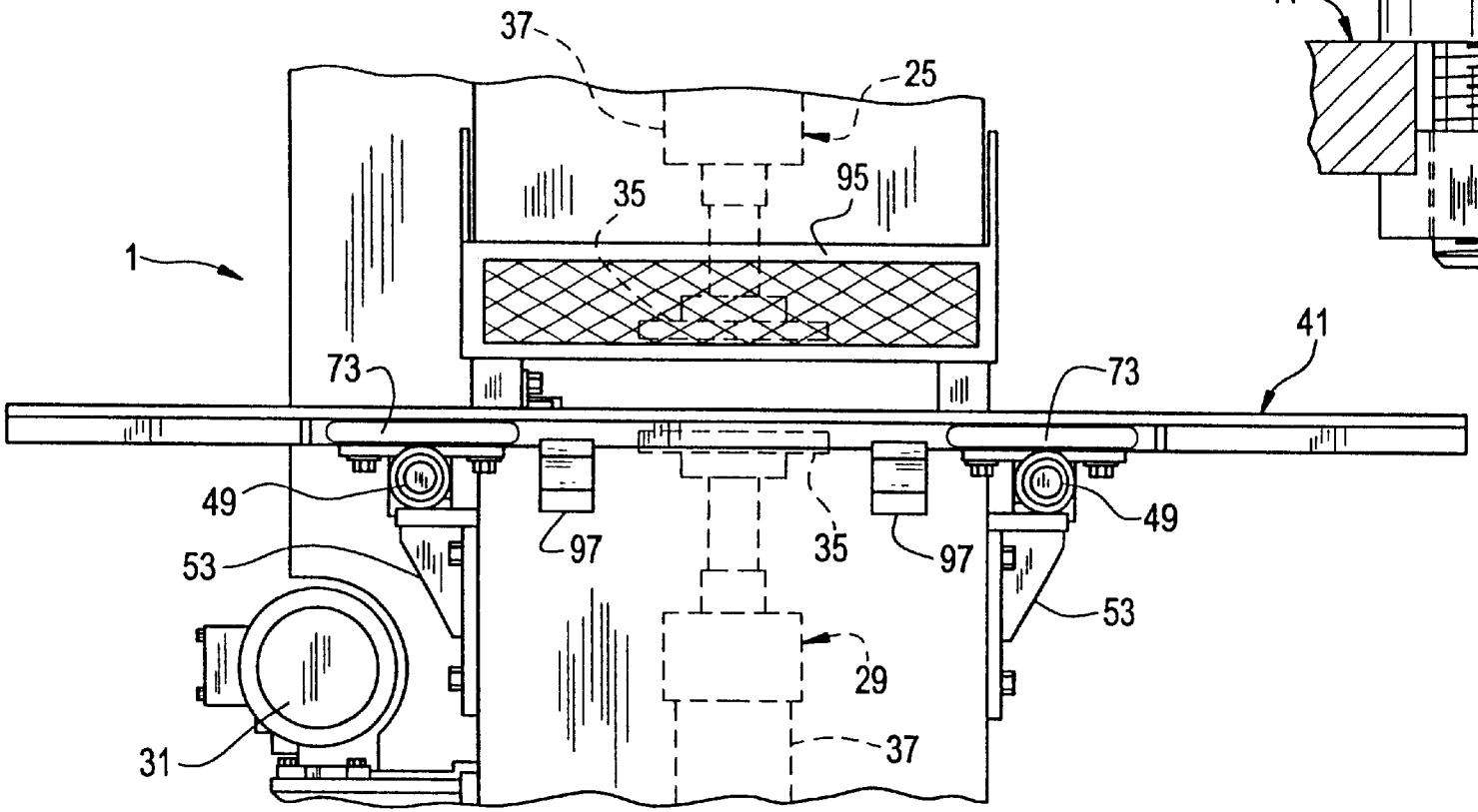
FIG. 5 is a view in elevation of a fragment of the front of the apparatus.

Mounted in the frame 1 is an upper feeder 23 operable to feed forward the upper strip 9 of connector plates from the upper coil 7 with its nails 21 extending down to bring the leading plate of the upper strip to a position for being segmented from the upper strip and driven downward. An upper driver 25 (FIG. 5) mounted in the frame functions to drive down the plate segmented from the upper strip. Mounted in the frame 1 directly below the upper feeder is a lower feeder 27 operable to feed forward the lower strip 19 of connector plates from the lower coil 17 with its nails 21 extending up to bring the leading plate of the lower strip to a position for being segmented from the lower strip and driven upward. A lower driver 29 (FIG. 5) mounted in the frame functions to drive up the plate segmented from the lower strip. Each feeder generally comprises a wheel rotary on a horizontal axis contacting the respective strip, the wheel being adapted to be driven on each cycle of operation of the apparatus to advance the respective strip one connector plate length by a motor 31 via a drive indicated at 33. Each of the connector plate drivers 25, 29 comprises a presser platen 35 on the plunger of a hydraulic cylinder 37, the upper presser platen being movable down for pressing down the connector plate segmented from the upper strip 9, the lower presser platen being movable up for pressing up the connector plate segmented from the lower strip 19. At 39 is indicated means for supplying the hydraulic cylinders with hydraulic fluid under pressure and controlling them (FIG. 2). A control panel 40 is provided for setting the operating parameters of the apparatus 1. The apparatus as thus far described corresponds essentially to that disclosed in the aforesaid copending coassigned application Ser. No. 09/347,326, and reference may be made thereto for details.

In accordance with this invention, a table 41 is shown for emplacement thereon of wood members, such as the wood members indicated at 43 and 45 (FIGS. 6 and 7) in a pattern for being fastened together. The table 41 is mounted for movement on the frame 1 between a position for emplacement of the wood members thereon out from between the upper and lower drivers 25 and 29 shown in phantom in FIG. 5 and a position between the drivers shown in solid lines in FIG. 4 for the driving of a connector plate segmented from the upper strip 9 down, and the driving of a connector plate segmented from the lower strip 19 up through an opening 47 in the table, for penetration of the nails 21 of the segmented plates into the wood members 43, 45.

Figure 4:
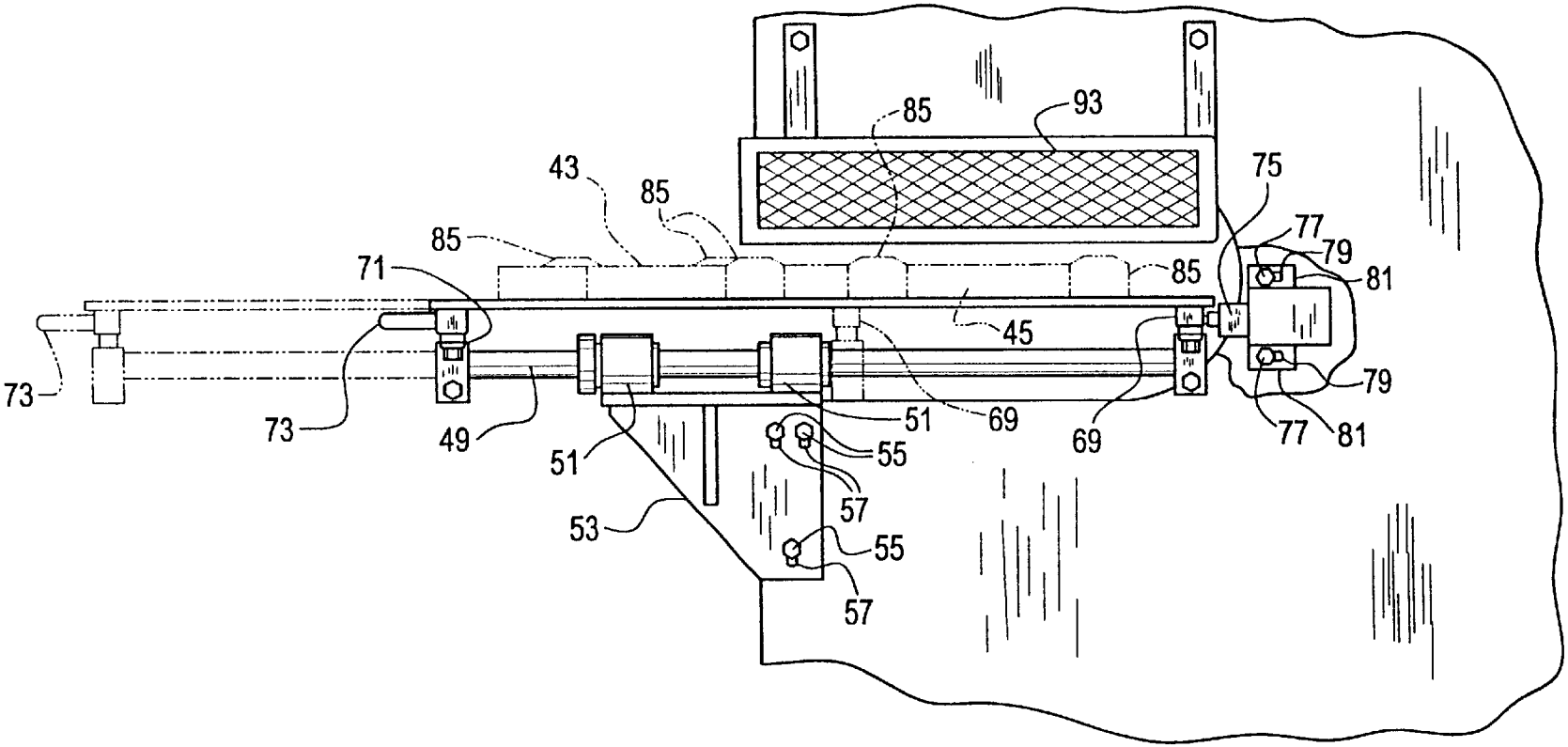
FIG. 4 is a view in elevation of a fragment of the other side of the apparatus, showing in phantom a moved position (the loading position) of a table thereof.

The table 41 is mounted for sliding movement between its above-stated in and out positions (which may also be referred to as its plate-driving position and loading position) in a generally horizontal plane by means of a set of rods, more particularly two rods each designated 49, and a set of slide bearings, more particularly a pair of linear bearings each designated 51 on one side and a pair of linear bearings each designated 51 on the other side under the table. Each pair of bearings is fixed on top of a bracket 53 mounted for up and down adjustment on the respective side of the frame 1 by means of screws 55 extending through generally vertical slots 57 in the bracket and threaded in tapped holes in the frame, the two bearings on each bracket being spaced one from the other on the bracket as shown in FIG. 4. The brackets with the bearings thereon are mounted on the frame with their axes extending parallel to one another on opposite sides of the throat 59 between the drivers 25 and 29 in a generally horizontal plane below the plane of the table 41. The rods 49 are secured to the table in position below the table spaced down from the table extending parallel to one another in the plane of the bearings 51 (and generally parallel to the plane of the table), being slidable in the bearings for the aforesaid sliding movement of the table between its aforesaid two positions. The table 41 has an inner edge 61, namely the edge which is innermost with respect to the throat (rearward with respect to the apparatus), and an outer (front) edge 63. Extending crosswise of the table on the bottom thereof adjacent its inner and outer edges are bars 65 and 67, the bar adjacent the inner edge 61 being denoted the inner or rear bar and the bar adjacent the outer edge being denoted the outer or front bar. Each of the rods is secured to the table in position under and spaced from the bottom surface of the table by a pair of rod supports 69 and 71, the support 69 being adjacent the inner end of the rod and the support 71 being adjacent the outer end of the rod. The inner end support 69 comprises a collar encircling the rod depending from bar 65 and the outer end support 71 comprises a collar encircling the rod depending from bar 67.

Each of the two inner bearings 51 of each pair of bearings on the brackets 53 is mounted in position with respect to the frame 1 to act as a stop engageable by the rear collar 69 of the respective inner end rod support on pulling out the table to determine its aforesaid loading position. Handles 73 are provided at the front of the table for being grasped to pull it out to the loading position, in which the inner (rear) edge 61 of the table is near the outer (open) end of the throat 59 (its front end). The handles are attached to bar 67. Mounted in the frame at the inner end of the throat 59 is a limit switch 75 engageable by the rear bar 65 of the table. The upper and lower drivers 25 and 29 cannot be activated when the table 41 is out of contact with the limit switch. This limit switch is adjustable in and out as needed to position the table. For that purpose, the limit switch 75 is mounted on the frame 1 by means of screws 77 extending through generally horizontal slots 79 in wings 81 on the stop threaded in tapped holes in the frame. A stop engageable with the forward bearing 51 to determine the aforesaid position for the driving of connector plates into the wood members of the table 41 is provided by a collar 83 on one or both rods 49 adjustable to different positions thereon for engagement with the front of one or both of the forward bearings 51 as shown in FIG. 4.

Figure 8:
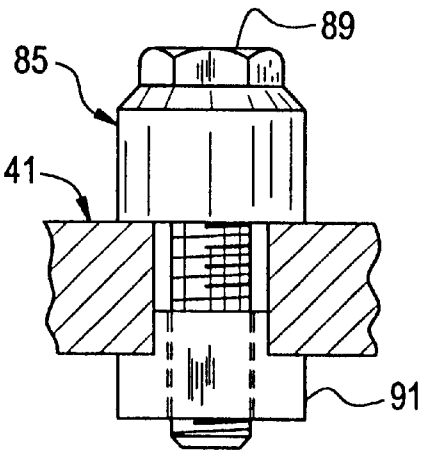
FIG. 8 is a section taken generally on line 8—8 of FIG. 7 illustrating a jigging stop of the apparatus.
Figure 6:
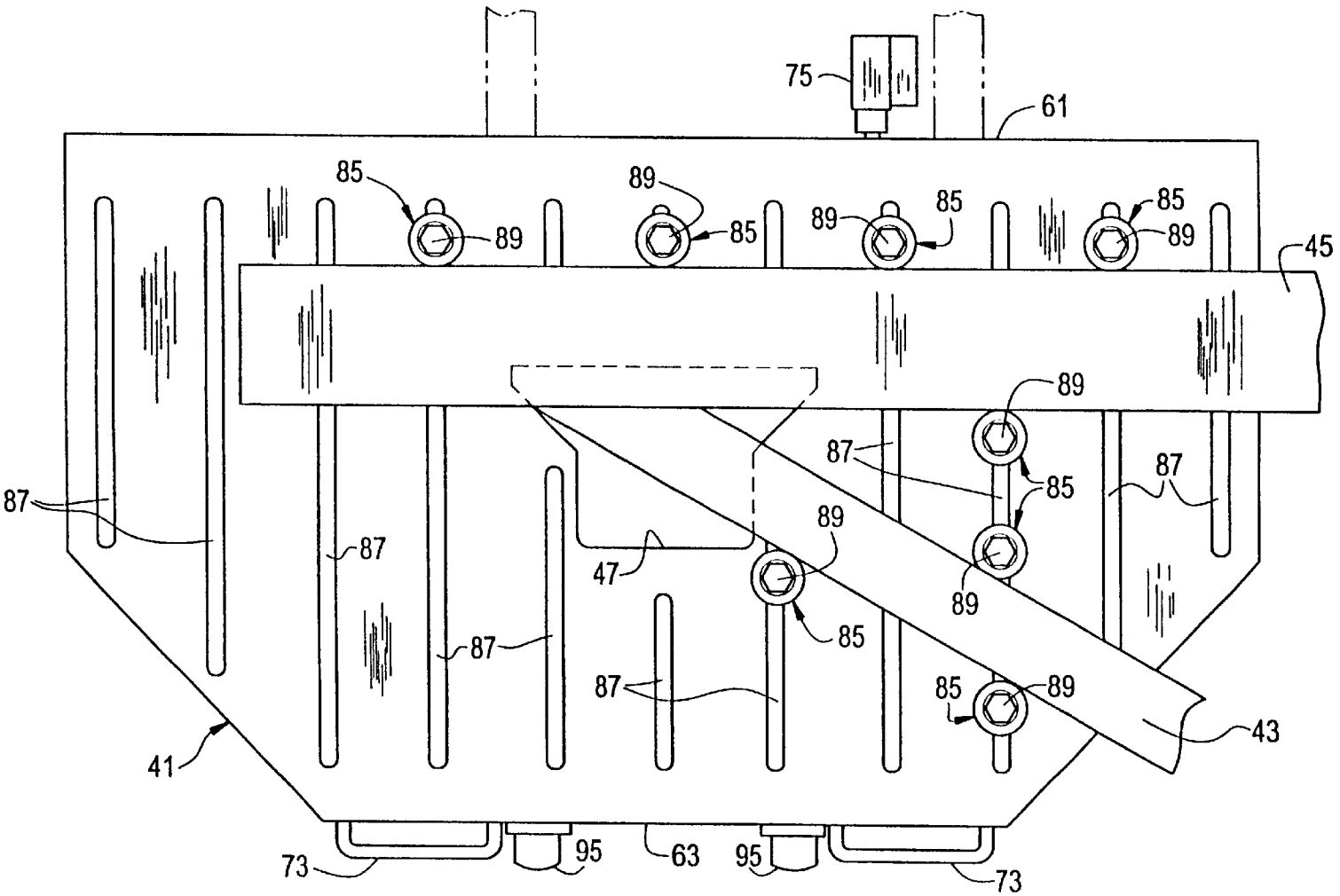
FIGS. 6 and 7 are views of the table taken generally on lines 6—6 and 7—7 of FIG. 5 illustrating a first wood member and a second wood member of a hip girder jigged in position for being fastened together with connector plates by the apparatus.
Figure 7:
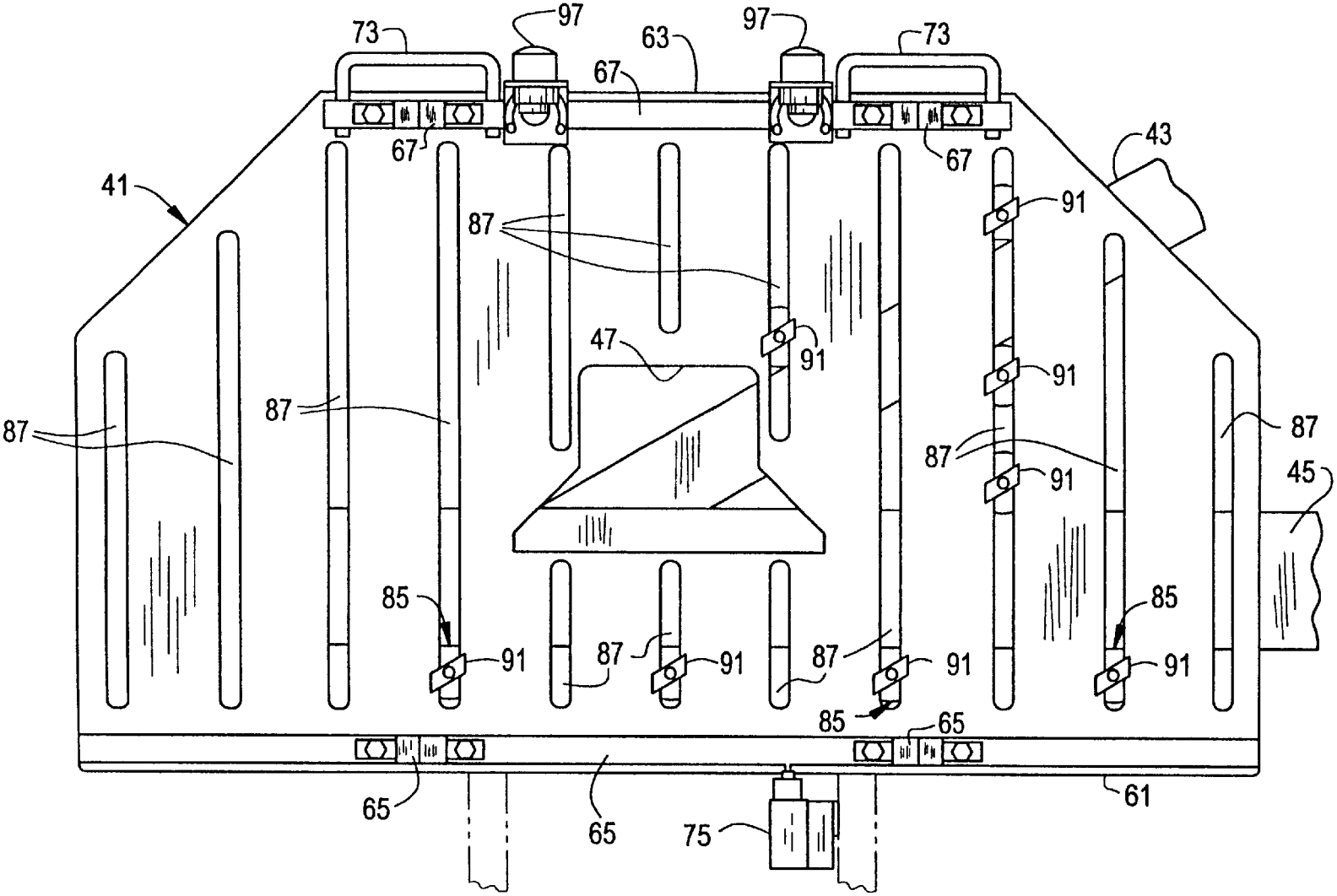

Referring to FIGS. 6–8, the table 41 carries jigging members, more particularly stops each designated 85, for jigging the wood members in the pattern for the connection thereof by the connector plates. As shown, the table is made with a series of slots 87 therein, the slots extending parallel to one another in front-to-rear direction with respect to the throat 59. It is to be understood that the slots may extend in a side-to-side direction with respect to the throat 59 or in some combination of front-to-rear and side-to-side without departing from the scope of the present invention. Further, it is envisioned that instead of slots a large number of circular holes (not shown) could be provided in the table. The holes would be threaded so that stops having threaded pegs could be screwed into the holes. Different jigging arrangements would be made by selecting different holes into which to place the stops. In the illustrated embodiment, each stop 85 is releasably fastened in selected position along the length of a slot extending up from the table for the jigging of wood members on the table in a selected pattern by having a bolt 89 of smaller diameter extending through the stop. The stop 85 has a downwardly facing shoulder engaging the top surface of the table on opposite sides of the slot with the bolt 89 extending down through the slot. A quarter turn nut 91 threaded on the bolt 89 engages the bottom surface of the table for fastening the stop 85 in place.

FIGS. 6 and 7 show an arrangement of the stops 85 for positioning (jigging) the first wood member 43 and the second wood member 45 of a hip girder of a type wherein the first wood member extends at an acute angle from the second wood member and the second wood member extends beyond the first wood member, with the juncture of the members registering with opening 47 in the table. The wood members are laid on the table in the pattern shown by placement between the stops defining the pattern with the table pulled out in its loading position so that there is no obstruction to the placement of the wood members. Then, the table 41 is pushed in to bring the juncture into the position for the driving of a top connector plate and a bottom connector plate into the wood members (which form chords in a truss or the like) at said juncture, the bottom plate being driven up through hole 47 which is positioned therefor in accordance with the positioning of the table resulting from its engagement with the stop 83.

For safety, the apparatus may be provided with side guards 93 and a front guard 95 for the throat.59. These guards are preferably fixed in place because the table can be moved out so there is no need for access to the throat 59. However, conventional movable guards could also be used. A pair of finger actuated switches 97 are provided for triggering the drivers 25, 29 to shear connector plates from the coils and drive them into the wood members when the table 41 is in position. The switches 97 must be depressed substantially simultaneously to trigger the drivers to inhibit the operator from triggering the driver unless his hands are well clear of the throat 59. In the preferred embodiment, the actuator switches 97 are DUO-TOUCH Model No. OTBA5QD photoelectric touch switches available from Banner Engineering Corporation of Minneapolis, Minn.

Figure 9:
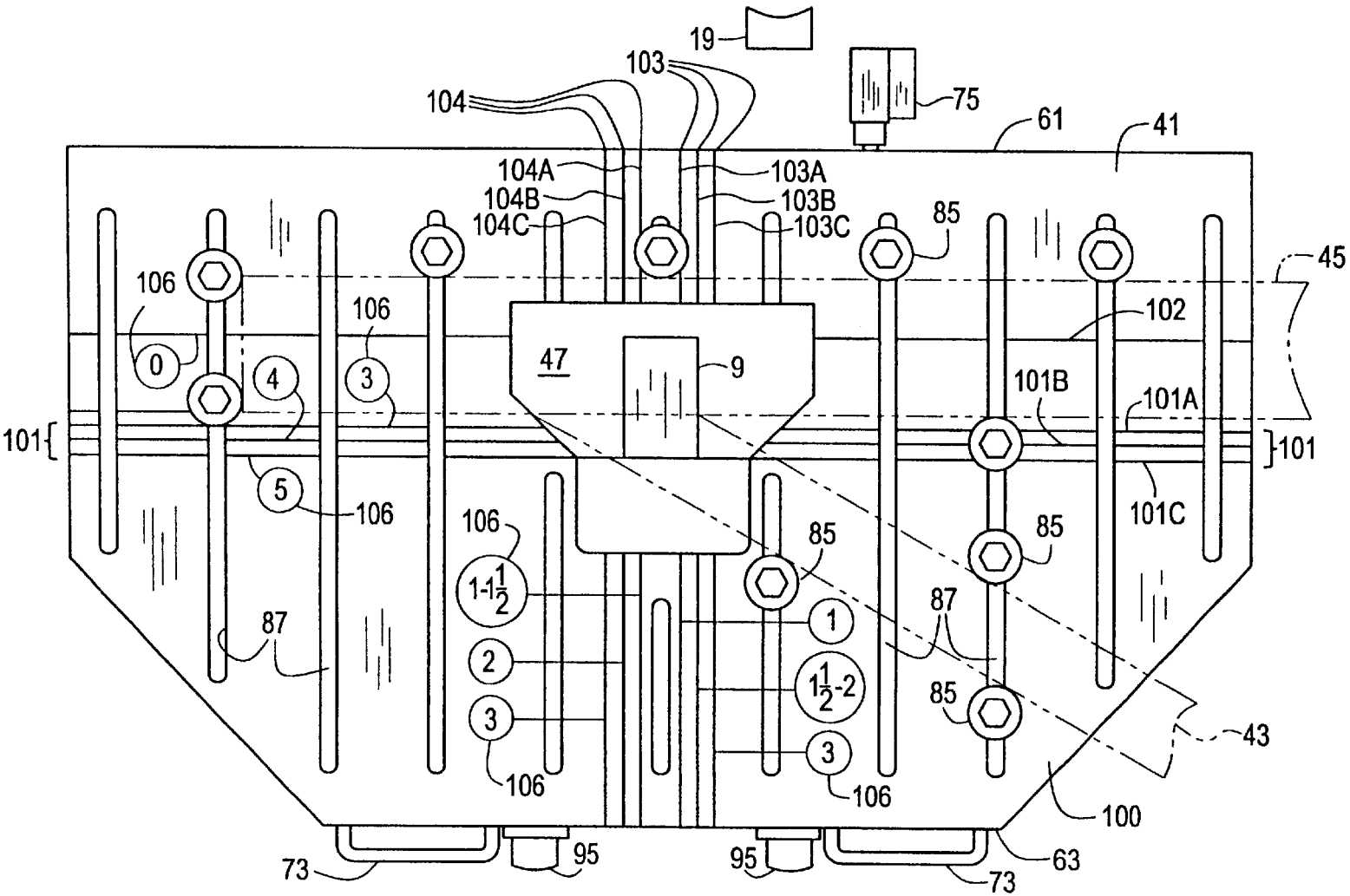
FIG. 9 is a plan view of the table showing an alternative embodiment of the apparatus including connector plate location indicia.

As best seen in FIG. 9, means is provided to facilitate setting the stops 85 in the desired X-Y positions relative to the table 41 for forming the desired joint between the wood members 43, 45. The means assists in locating the stops 85 such that the selected connector plate will be properly positioned for pressing into the wood members preferably without any portion of the connector plate 9 extending beyond the edges of the wood members and having all the nails of the connector plate 9 within the wood members. The location of a connector plate 9, the wood members 43, 45 and stops 85 in the following description are the X-Y locations on the table 41 in one or more planes generally parallel to the upwardly facing surface 100 of the table.

The means includes indicia on the upward facing surface 100 of the table 41 indicative of the locations of the side edges and end edges of the variously sized connector plates. The indicia in the structure of FIG. 9, includes a plurality of lines 101–104 formed in the upwardly facing surface 100. Preferably, the lines 101–104 are scribed into the upwardly facing surface 100. A preferred width for the lines is about 1/16". One end edge of each of the different sized connector plates, in the preferred embodiment, are commonly located and thus share the same indicia line 102, i.e., the end edges at the location of shearing of the connector plates from the coil. The indicia includes a plurality of generally parallel lines 101A–C indicating. the location of the leading end edge of each of the different connector plates on a coil when positioned for pressing into the wood members. For example, the line 101A indicates the location of the leading end edge of a 3" long connector plate, the line 101B indicates the location of the leading end edge of a 4" long connector plate and the line 101C indicates the location of the leading end edge of a 5" long connector plate. The line 102 indicates the location of the trailing end edge of a connector plate which is the location where the connector plate is severed, as by shearing, from a coil when the table 41 is in its in position as described above. The lines 102, 10A–C are generally parallel and indicate the Y locations of the end edges of the connector plates.

The indicia further includes lines 103, 104 indicating the X locations of the side edges of the connector plates. As shown, the latter described lines include lines 103A–C and lines 104A–C . The lines 103A–C are generally parallel to one another and generally parallel to the lines 104A–C which are also generally parallel to each other. For example, the line 103A indicates the location of the right hand side edge (as viewed in FIG. 9) of a 1" wide connector plate 9, the line 103B indicates the location of the right hand side edge of both 1½" and 2" wide connector plates and the line 103C indicates the location of the right hand side edge of a 3" wide connector plate. In the illustrated embodiment, the lines 104A–C indicate the various locations of the left hand side edges (as viewed in FIG. 9) of various connector plates. For example, the line 104A indicates the location of the left hand side edge of 1" and 1½" wide connector plates 9, the line 104B indicates the location of the left hand side edge of a 2" wide connector plate and the line 104C indicates the location of the left hand side edge of a 3" wide connector plate. The lines 101–104 can be used to designate any length or width of connector plate, and the above described lines are merely representative of certain sized generally rectangular plates.

Alternatively, the orientations and locations of the lines can be changed to accommodate any size or shape of connector plate. The surface may also include identification indicia 106 indicating which size nailing plate the various lines 101–104 represent. One such size indicating indicia includes scribed numbers as seen in FIG. 9. The lines 101–104 may also be color coded, for example the lines 101B, 103C, and 104C may be coded red to indicate the location of the side edges and leading end edge of a 4" long by 3" wide nailing plate. In the alternative, should the trailing end edge vary in location relative to the table when it is in its in position, a plurality of lines 102 may be used to indicate the various trailing end edge locations. In some cases, it may be possible to use only a single reference line for the Y location and also for the X location depending on the sizes of the connector plates 9 and whether they share a common side edge and/or a common end edge. Preferably, the lines 103, 104 extend between the front and back edges 63, 61 and the lines 101, 102 extend between the side edges 98, 99 of the table 41 except for in the opening 47 with the lines 101, 102 being generally perpendicular to the lines 103, 104 for rectangular plates.

In operation, the table is moved to its out or extended position. The wood members (two in the illustrated embodiment), are placed on the table in the orientation relative to one another that they are to be joined together with one or more connector plates 9. The lines 101–104 are then used by the operator to sight along to accurately position the wood members in their X-Y locations to receive the connector plate(s) in the desired location on the joined wood members as indicated by the respective lines 101–104. The operator selects the desired lines for the connector plate size to be used prior to sighting along the lines. The stops 85 are then secured, as described above, in the appropriate locations to fix the positions or locations of the wood member 43, 45 when fed into the nailing station for pressing in the connector plates 9 in a manner as described above. Thus, the stops may be more easily located than with a trial and error method reducing product waste and personnel time used in set-up. If desired, after set up, a sample joint can be made and refinement of the stop location can be made if needed. Set-up can be done with the table in its out position facilitating set-up and reducing the risk of operator mijury.

Figure 10:
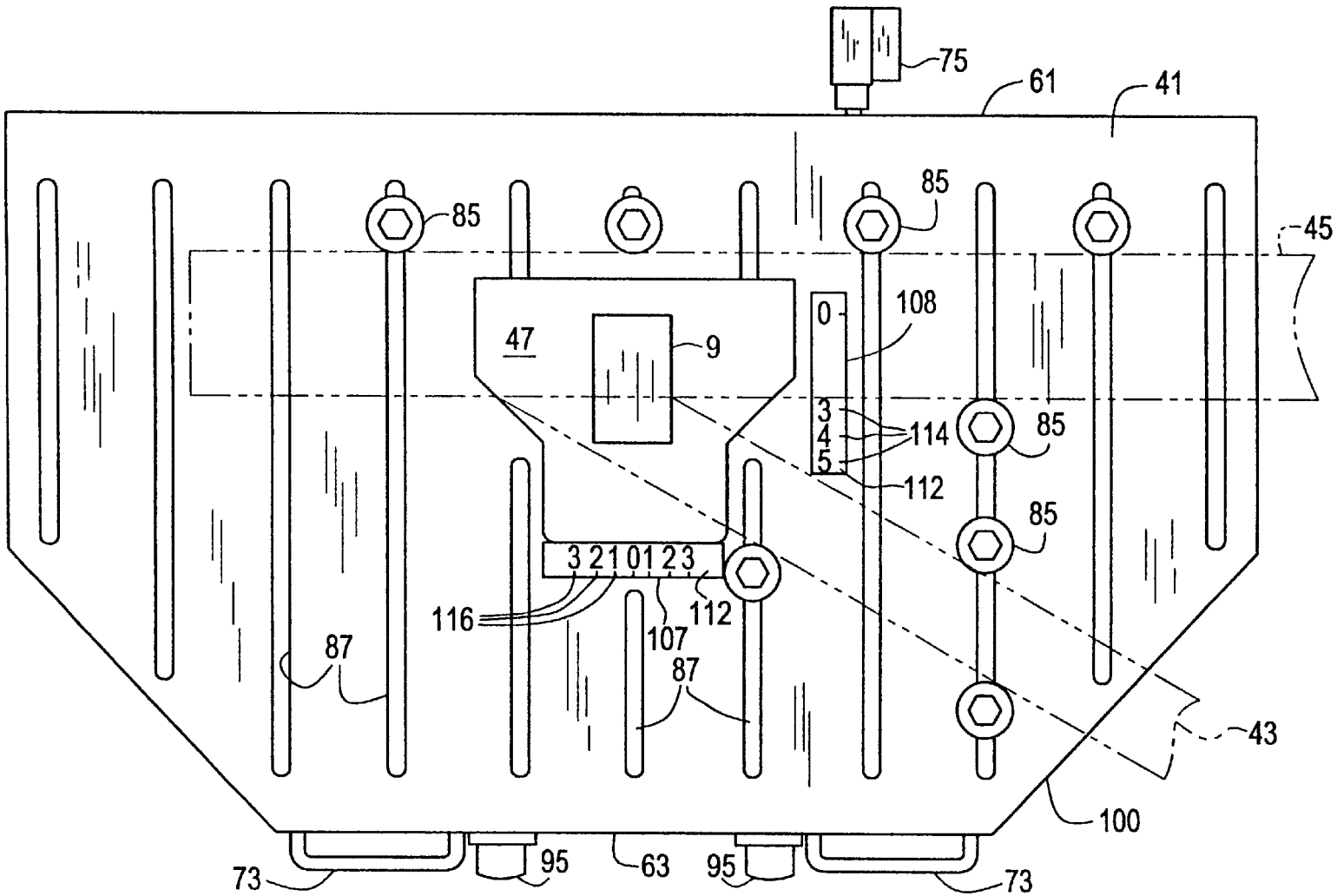
FIG. 10 is a plan view of the table showing an additional embodiment of connector plate location indicia.

In an alternate embodiment, the connector plate locating indicia may include one or measures mounted to the table 41. Such an embodiment is illustrated in FIG. 10. A preferred measure includes a pair of adhesive backed indexed scales 107, 108 secured to the upwardly facing surface 100 adjacent the opening 47 along at least two adjacent sides thereof. The measures could be secured in a recess in the surface 100 to reduce wear of the measures. The measure includes two scales 107 (X scale), 108 (Y scale) at generally right angles to one another. The Y direction is that direction that the connector plates 9 are fed into the pressing station and the X direction is generally normal to the Y direction and generally parallel to the trailing end of the connector plate, i.e. where it is sheared from the strip of plates. The measure can be a unitary structure or can have separate scales 107, 108. The single piece arrangement utilizes a scaled pattern 112 printed or scribed thereon to project the dimensions or other location indicia up and down (Y scale indicia 114) and across the measure (X scale indicia 116) to facilitate the location of the wood members and the stops 85. The indexing of the scales 107, 108 can be numeric indicating units of length or distance measure like inches or centimeters or other suitable scales including arbitrary indexing, e.g., alpha characters. Color coding of the indicia could also be used. A tabulation of the indicia value for the location of the edges of each given connector plate 9 can be provided to facilitate set-up by providing the X and Y scale coordinates for the plate edges. If the trailing edge is common for all connector plates 9, a zero value for the Y location on the Y scale 108 can be used for the trailing edge location indicator for all connector plates. In some cases, it may be possible to use only a single reference line or indicator value for the Y location and also for the X location depending on the sizes of the connector plates 9 and whether they share a common end edge and/or a common side edge respectively.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for connection of wood members or the like in which wood members are fastened together by at least one connector plate, said apparatus is adapted to use a variety of different sized connector plates including first and second connector plates of different sizes to form different configurations of fastened wood members, said first and second connector plates having integral nails extending from one face thereof and end and side edges, said apparatus comprising a driver for driving a connector plate into the wood members, a table for the emplacement thereon of the wood members in a pattern for being fastened together, said table having an upwardly facing surface adapted for engaging the wood members, said table having thereon indicia visible on said surface indicating the locations of at least some edges of the first and second plates in a plane generally parallel to the surface.

2. Apparatus as set forth in claim 1 wherein said indicia includes a plurality of lines on said surface, said lines indicating the locations of at least some edges of the first and second plates.

3. Apparatus as set forth in claim 2 wherein said plurality of lines includes a plurality of generally parallel first lines indicating the locations of opposite side edges of the first and second plates and a plurality of generally parallel second lines indicating the locations of end edges of the first and second plates.

4. Apparatus as set forth in claim 3 wherein said first and second plates having trailing end edges and leading end edges with said trailing end edges having a common location when in the apparatus and positioned for pressing into the wooden members.

5. Apparatus as set forth in claim 3 wherein said table is mounted for movement between a position out from under said driver for emplacement of said wooden members and a position under said driver for driving the plate down for penetration of its nails into said wood members, said table being mounted for sliding movement in a generally horizontal plane between said in and out positions.

6. Apparatus as set forth in claim 5 wherein the table carries stop members for jigging said wood members in said pattern.

7. Apparatus as set forth in claim 6 wherein said stop members are settable for different patterns of wooden members on the table.

8. Apparatus as set forth in claim 7 wherein said first and second plates each being supplied from a respective strip of first or second plates with the first and second plates in each strip being connected end-to-end lengthwise of the respective strip thereof, each said strip being supplied in coil format, each said plate being segmented from a respective said strip.

9. Apparatus as set forth in claim 8 wherein said apparatus further comprises a pair of feeders with one feeder being an upper feeder and the other feeder being a lower feeder, the upper feeder being operable to feed an upper said strip from an upper coil thereof and said lower feeder operable to feed a lower said strip from a lower coil thereof, said upper strip being fed forward with its nails extending down and the lower strip being fed forward with its nails extending up.

10. Apparatus as set forth in claim 1 wherein said indicia includes at least one index scale on said surface.

11. An apparatus as set forth in claim 10 including connector plate feeders for feeding the first and second plates to a respective position for emplacement in a first direction and wherein said index scale extends in an second direction generally normal to the first direction.

12. An apparatus as set forth in claim 11 wherein the index scale comprises a first index scale and wherein the apparatus further comprises a second said index scale with said first and second index scales being generally at right angles to one another.

13. An apparatus as set forth in claim 12 wherein said location indicia includes units of distance measure.

14. An apparatus as set forth in claim 1 further including identification indicia on the upwardly facing surface to identify certain of said indicia for the size of connector plate the indicia represents.

15. An apparatus as set forth in claim 14 wherein the identification indicia includes numeric characters on the upwardly facing surface and referencing respective said indicia.

16. An apparatus as set forth in claim 14 wherein the identification indicia includes alpha characters on the upwardly facing surface and referencing respective said indicia.

17. An apparatus as set forth in claim 14 wherein said identification indicia includes color coding of certain of the indicia.

18. A method of setting up an apparatus adapted to press connector plates into wood embers to join the wood members together, said apparatus comprising a table with an upwardly facing surface having connector plate location indicia thereon and adapted for supporting engagement with the wood members and including a plurality of stop members, mounted selective movement on said table and extending upwardly therefrom for positively locating said wood members thereon, said method including locating the wood members relative to one another and relative to the indicia indicating the desired location of a connector plate relative to the wood members, adjusting the stop members to engage edges of the wood members forming stops for positioning the wood members relative to one another in a desired orientation and securing the stop members in their adjusted positions thereby forming a positioning jig for locating wood members to be joined together with at least one said plate.

19. A method as set forth in claim 18 wherein said indicia is indicative of the locations of a plurality of different sized connector plates.

* * * * *

UNITED STATES PATENT AND TRADEMARK OFFICE

CERTIFICATE OF CORRECTION

PATENT NO. : 6,405,916 B1
DATED : June 18, 2002
INVENTOR(S) : Marc Olden

It is certified that error appears in the above-identified patent and that said Letters Patent is hereby corrected as shown below:

Column 9,
Line 15, “embers” should read -- members --.

Signed and Sealed this

Twenty-seventh Day of August, 2002

*Attest:*

*Attesting Officer*

JAMES E. ROGAN
*Director of the United States Patent and Trademark Office*